United States Patent [19]

Spano

[11] Patent Number: 4,677,810

[45] Date of Patent: Jul. 7, 1987

[54] METHOD AND APPARATUS FOR PLACING FLEXIBLE WEB PIECES INTO CONCAVE SHAPED SHELLS

[75] Inventor: John D. Spano, Bordentown Twsp., Burlington County, N.J.

[73] Assignee: Personal Products Company, Milltown, N.J.

[21] Appl. No.: 897,224

[22] Filed: Aug. 15, 1986

[51] Int. Cl.[4] ..... B65B 1/24

[52] U.S. Cl. ..... 53/428; 29/235; 29/453; 53/113; 53/251; 53/436; 53/473; 53/529; 414/753; 414/786

[58] Field of Search ..... 53/113, 115, 248, 251, 53/428, 429, 436, 438, 439, 473, 523, 529; 29/235, 450, 453; 198/468.2, 468.3; 294/88, 106; 414/226, 750, 753, 786

[56] References Cited

U.S. PATENT DOCUMENTS

| | | | |
|---|---|---|---|
| 3,209,923 | 10/1965 | Bargel et al. | 198/468.3 |
| 3,225,891 | 12/1965 | Hickin et al. | 53/251 |
| 3,605,238 | 9/1971 | Escahole | 29/235 |
| 3,766,706 | 10/1973 | Graham | 53/529 |
| 4,106,264 | 8/1978 | Hanscom | 53/436 |
| 4,571,804 | 2/1986 | Grabler et al. | 29/235 |

*Primary Examiner*—Robert L. Spruill
*Assistant Examiner*—Donald R. Studebaker

[57] ABSTRACT

A method and apparatus for placing multiple crimped flexible pieces into concave formed shells. In the method, a plurality of flat fibrous web pieces are provided on a shuttle device and are picked up and crimped longitudinally by gripper fingers, and each piece is transferred laterally to a location over a formed shell then lowered and inserted into the shell. While the pieces are on the shuttle device they are moved apart from each other. Also, during lateral transfer the crimped pieces are moved longitudinally and are also bowed longitudinally while being placed into the concave formed shells. Suitable apparatus is also disclosed for picking up and crimping the flexible pieces and laterally transferring the pieces and placing them in the concave formed shells.

16 Claims, 8 Drawing Figures

METHOD AND APPARATUS FOR PLACING FLEXIBLE WEB PIECES INTO CONCAVE SHAPED SHELLS

BACKGROUND OF INVENTION

This invention relates to a method and apparatus for placing flexible articles into concave shaped receptacles. It particularly relates to mechanically picking flat fibrous web pieces and placing them into flexible concave shaped foam shells.

Mechanical picking and placing of various articles into specific locations is generally known, such as that utilized in theproduct packaging industry. Also, in recent years, various robot devices have been developed for use in repetitive article transfer operations, such as used in machine assembly and such. However, such prior activity has usually involved accomplishing only a physical lateral or vertical movement of a part or piece, but not performing any useful operation on the piece during such movement or transfer. A method and apparatus for combined shaping and dual transfer operations for flexible articles have now been advantageously developed and provided by the present invention.

SUMMARY OF THE INVENTION

This invention provides a method for rapidly picking and placing multiple flat flexible pieces into concave formed shells located adjacent each other. The method of the invention includes the steps of: providing a plurality of flat, flexible pieces disposed parallel to each other on support rails; picking up the pieces while simultaneously longitudinally crimping the pieces to have a convex-shaped upper surface; and laterally transferring at least two pieces and placing them into concave formed shells, which are each shaped to retain the crimped web pieces in the shell.

At least two pieces are preferably provided in an end-to-end relationship with the pieces being each placed on upwardly extending pins of a shuttle conveyor, which moves the adjacent parallel web pieces apart from each other. Also, the adjacent pieces from the support rails are moved longitudinally apart relative to each other while simultaneously being transferred laterally from the shuttle conveyor rails and placed into the concave formed shells. The invention additionally includes bending longitudinally the ends of the pieces while placing the pieces into the formed shells. The flat flexible pieces are preferably elongated fibrous web pieces each having dimensions of 6–10 inches long, 3–5 inches wide, and 0.4–1.0 inches thick.

The present invention also provides an apparatus for picking up and crimping multiple flexible pieces, moving the crimped pieces transversely and placing them into specific cavities, such as into formed shells integrally attached to a foam sheet. The apparatus of the invention includes conveyor means for supporting a plurality of flexible web pieces, the conveyor means having a shuttle device located below rails for contacting and longitudinally moving the web pieces;

gripper means for clamping and picking up the multiple web pieces and crimping the pieces longitudinally; and transfer means for moving the multiple crimped web pieces laterally and placing each piece into a specific location in a formed shell. The shuttle conveyor is adapted for moving apart the adjacent web pieces from each other. The transfer means includes lower and upper carriage units supported by dual horizontal support rods and moved in opposite directions by a chain running on dual sprocket wheels. The transfer means also consists of two adjacent units each adapted for changing the spacing of the web pieces in an end-to-end relationship to each other during their lateral transfer movement.

It is an advantage of this invention that multiple flexible web pieces are rapidly picked up and crimped longitudinally while being rapidly transferred laterally and placed into concave formed shells, the entire operation being accomplished at a cycle time of 3–5 seconds. The web pieces are preferably corrugated longitudinally and are inserted in flexible formed shells made of an ethylene-containing foam material.

DESCRIPTION OF INVENTION

This invention will now be further described by reference to the above drawings. Referring first to the FIG. 4 general perspective view, multiple flat flexible pieces 10 such as fibrous web pieces which have been previously cut from a web sheet by suitable cutting means (not shown), are provided in an adjacent parallel pattern supported on a conveyor device 20 having multiple parallel support rails 21. The web pieces 10 are generally flat and flexible, and preferably are corrugated longitudinally and have an elongated shape with a length/width ratio between about 1.5/1 and 3/1. At least two flexible web pieces oriented in an end-to-end relationship are usually provided on rails 21, and preferably 4–10 pieces are provided oriented parallel to each other in dual rows supported on the rails 21.

Figure 1:
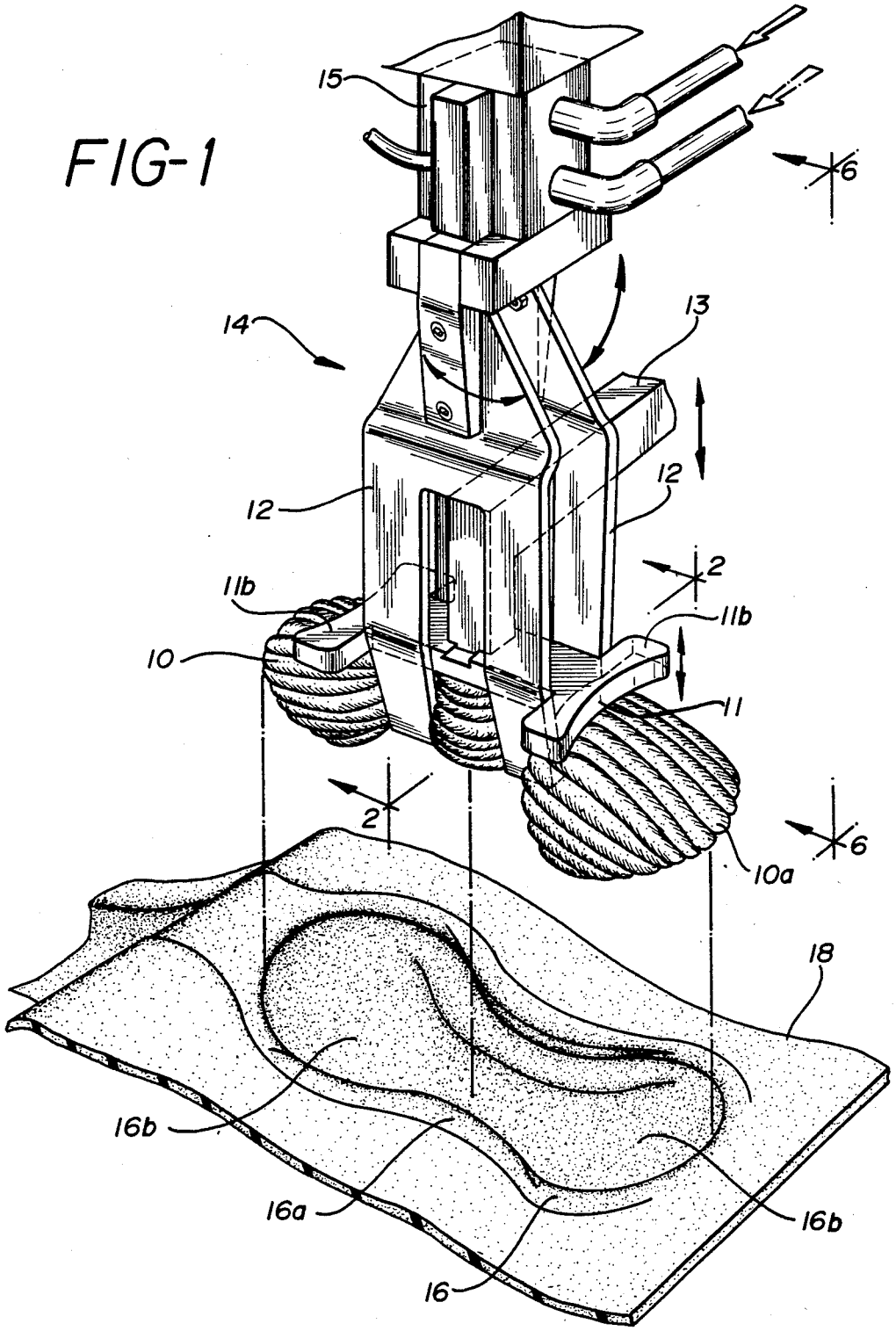
FIG. 1 is a perspective view showing a gripper unit adapted for picking, crimping and vertically placing a flexible piece into a formed shell in accordance with the invention.
Figure 4:
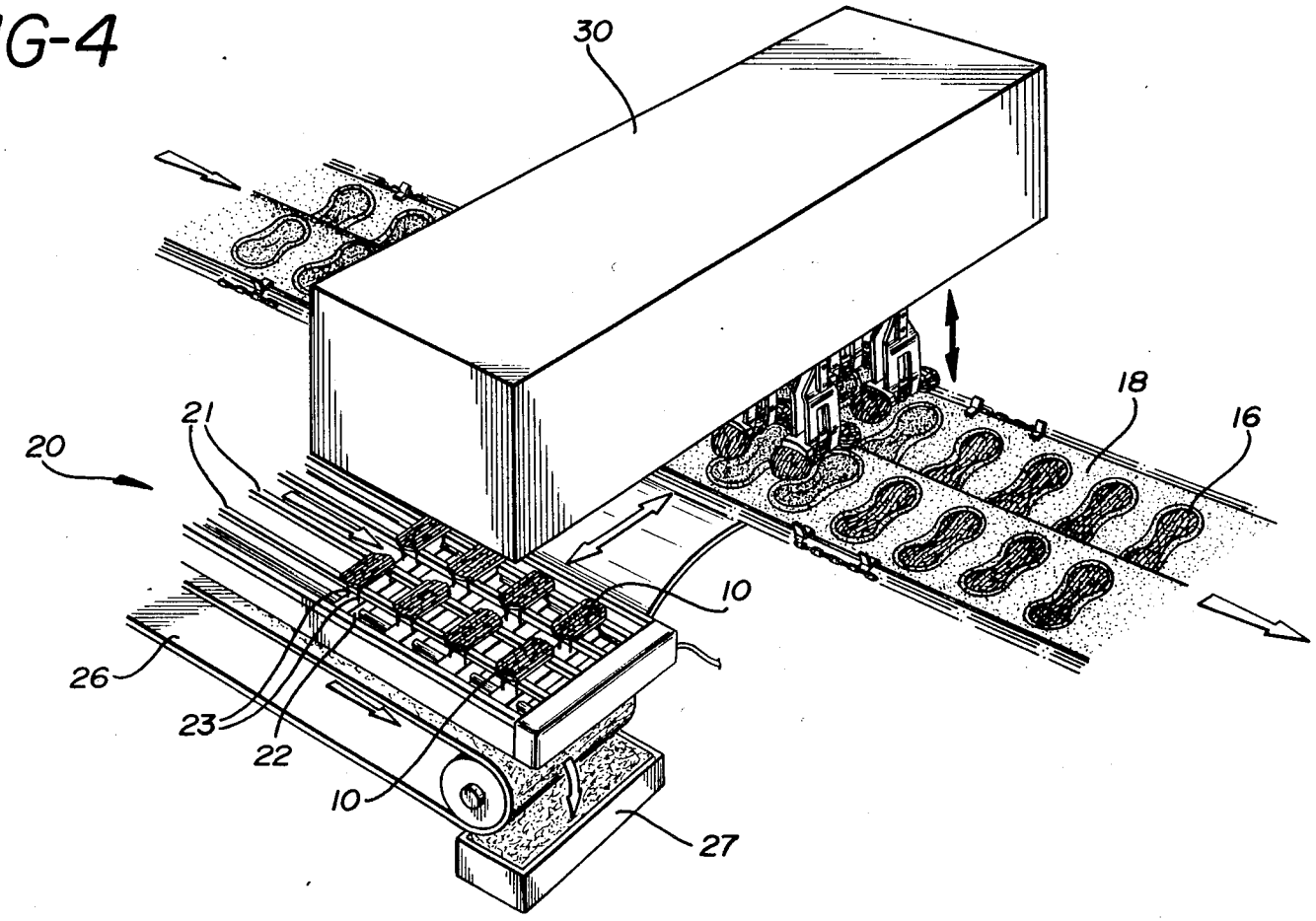
FIG. 4 is a general perspective view showing the picking and placing method and apparatus arranged for placing multiple web pieces into formed shells in accordance with the invention.

Referring now to FIG. 1, one of the corrugated flexible web pieces 10 shown in FIG. 4 and which initially has a generally flat shape, is grasped at its central portion by dual pivotable fingers 12 of a gripper unit 14. The flexible piece 10 is bowed upwardly along a central longitudinal portion so that its convex-shaped upper side contacts the lower curved side of stop-tamp 11, which is supported between the pivotable fingers 12, by arm 13. The lower side surface 11a of stop-tamp 11 is curved in the transverse direction and also has ears 11b provided at each end which assist in inserting the bowed web piece 10*a* into formed shells 16. The bowed and crimped web piece 10*a* is moved downwardly by action of a pneumatic piston (not shown) located above gripper unit 14 and is placed into a formed shell 16, which is usually formed in and integrally attached to a foam sheet 18. As shown in FIG. 1, the shell 16 is generally boat-shaped and has a central narow portion 16*a* and curved ends 16*b* where the shell cavity curves upwardly to coincide with the upper surface of foam sheet 18. After the crimped web piece 10*a* is inserted into shell 16, fingers 12 are pivoted outwardly by a pneumatic operated piston unit 15 to release the crimped 10*a*, after which gripper unit 14 is moved upwardly.

The foam sheet 18 is preferably an ethylene-containing polymer foam shell prepared by thermal molding processing. One preferred formulation for forming the ethylene-containing polymer foam material is identified as Volara Type A, which is a cross linked polyethylene foam manufactured and sold by Voltek, Inc., Lawrence, Mass. The expression "ethylene-containing polymer foam" used herein includes polyethylene homopolymer and ethylene-containing copolymers, preferably containing a major portion, by weight, of ethylene. It is preferred that the polymer present be crosslinked. Preferred comonomers, for preparing the polymers, including vinyl acetate, acrylic and methylacrylic acids and esters, such as ethyl acrylate. Blends of such polymers can also be used.

Figure 2:
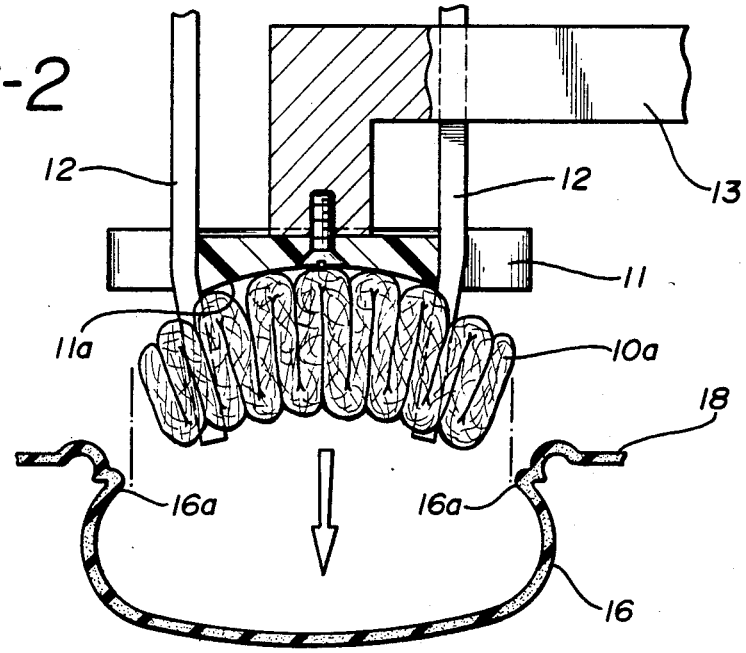
FIG. 2 shows a sectional view showing a crimped web piece and a concave formed shell taken at line 2—2 of FIG. 1.
Figure 3:
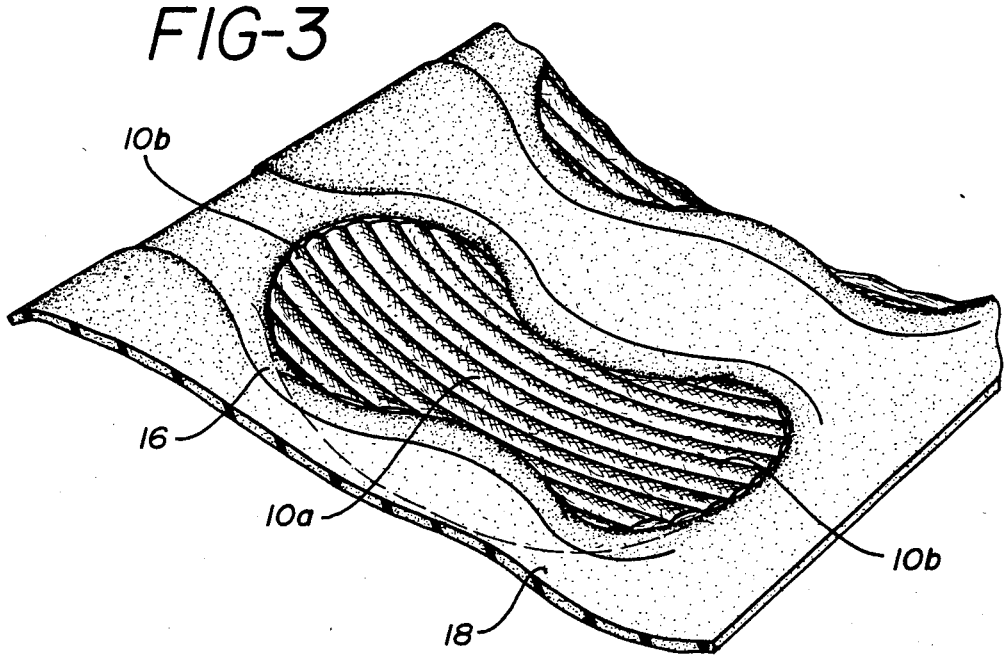
FIG. 3 is a perspective view showing a crimped web piece after being placed into a concave formed shell.

As is further shown in the FIG. 2 sectional view, the crimped corrugated web piece 10*a* is moved downwardly and inserted into formed shell 16 by action of the dual clamp fingers 12 and stop-tamp 11. Also, as the crimped piece 10*a* is inserted into the shell 16, the opposite ends 10b of the piece are bent upwardly by the shell curved shaped end portions 16*b* so that piece 10*a* fits snugly into shell 16. FIG. 3 shows the curved shape of web piece 10*a* after being placed into t he shell 16 past the narrow central portion 16*a* of the shell, which narrow portion helps retain the web piece 10*a* snugly within the shell.

As generally shown by FIG. 4, the multiple flat web pieces 10 which have been previously cut from a web sheet by suitable die cutting means (not shown), are provided at 10 in an adjacent parallel pattern supported on a conveyor device 20 having multiple parallel support rails 21. The web pieces 10 are generally flat and flexible, and preferably have an elongated corrugated shape with a length/width ratio between about 1.5/1 and 3/1. At least two flexible web pieces 10 are provided oriented in an end-to-end relationship on the rails 21, and preferably 4–10 adjacent web pieces are provided in dual rows generally as shown. The multiple pieces 10 are initially provided in a close side-by-side relationship on the rails 21 of the shuttle conveyor device 20. The conveyor device also includes shuttle blocks 22 each having multiple pins 23 which protrude upwardly between the rails 21, so as to contact and move the web pieces 10 forward on the rails.

While the web pieces 10 are moved forward to a desired location on the rails 21, the pieces are also preferably moved longitudinally apart from each other by a desired distance, such as by 0.5–2.0 inches by action of shuttle blocks 22. The blocks 22 are then quickly dropped and are moved back to their initial position and the forward transfer operation of additional web pieces 10 is repeated as desired. If desired, the web pieces 10 is repeated as desired. If desired, the web pieces 10 provided on conveyor 20 may contain absorbent particles, and any particles which may fall from the web pieces are caught by moving belt 26 located below the rails 21 and deposited in receptacle 27.

Figure 5:
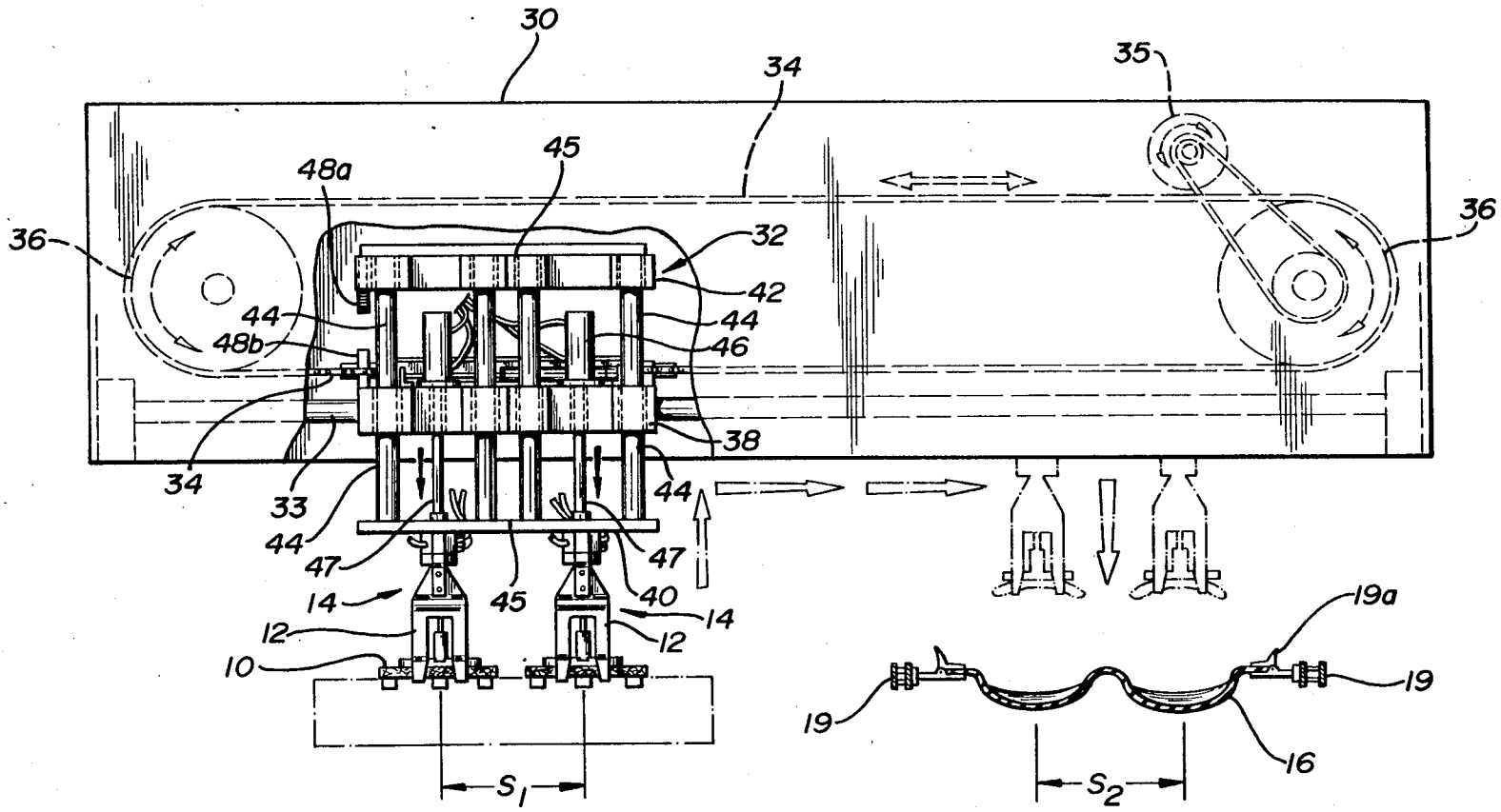
FIG. 5 shows a schematic elevation view of the method and apparatus for picking and laterally transferring multiple parallel web pieces and placing them into the formed shells.

After the multiple parallel pieces 10 have been moved laterally apart on the rails 21, they are next picked up and transferred laterally by a transfer device 30 and placed into adjacent formed shells 16, as is shown in greater detail by FIG. 5. For this lateral transfer movement, the flexible web pieces 10 are grasped and crimped longitudinally by the dual fingers 12 of grippers 14, which are supported by a carriage unit 32. As was described above relative to FIGS. 1 and 2, the web pieces 10 when in a flat position are grasped in a midportion by the fingers 12 and are crimped upwardly against curved surface 11a of stop-tamp 11. The crimped pieces 10*a* are picked up vertically by action of a pneumatic piston 46 and are transferred laterally by device 30 to an adjacent position above formed shells 16, and are then lowered by piston 46 and placed into the shells. At least two web pieces 10 oriented in an end-to-end relationship are picked up and transferred simultaneously by each cycle of movement of the transfer means 30, and preferably 4–10 web pieces 10 are provided in parallel orientation with each other and are transferred by each movement cycle, as is generally shown by FIG. 4.

As shown in detail by FIG. 5, the carriage unit 32 is supported on dual horizontal support rods 33, and is moved back and forth on the support rods by an endless chain 34 which is connected to unit 32 and runs on dual sprocket wheels 36. The chain 34 is suitably driven in alternate opposite direction by a reversible motor 35 rotatably connected to one of the sprocket wheels 36. Alternatively, the carriage unit 32 can be reciprocated on rods 33 by pneumatic piston drive means (not shown). Carriage unit 32 includes an intermediate carriage member 38 which is supported by the horizontal rods 33 and to which chain 34 is attached. Carriage unit 32 also includes a lower carriage member 40 to which the gripper units 14 are attached, and an upper member 42. The lower member 40 and upper member 42 are attached together by four vertical rods 44, which reciprocably sslide within mating vertical holes provided in lower member 38. The alternate direction vertical movement of members 40 and 42 is produced by pneumatic piston 46, which is supported by intermediate member 38 and has piston rod 47 attached to the lower member 40. The downward movement of gripper units 14 is controlled by adjustable stop means 48 which includes rod 48*a* threaded into upper member 42 and contacts lower stop 48*b* attached to the upper side of intermediate member 38.

Figure 5A:
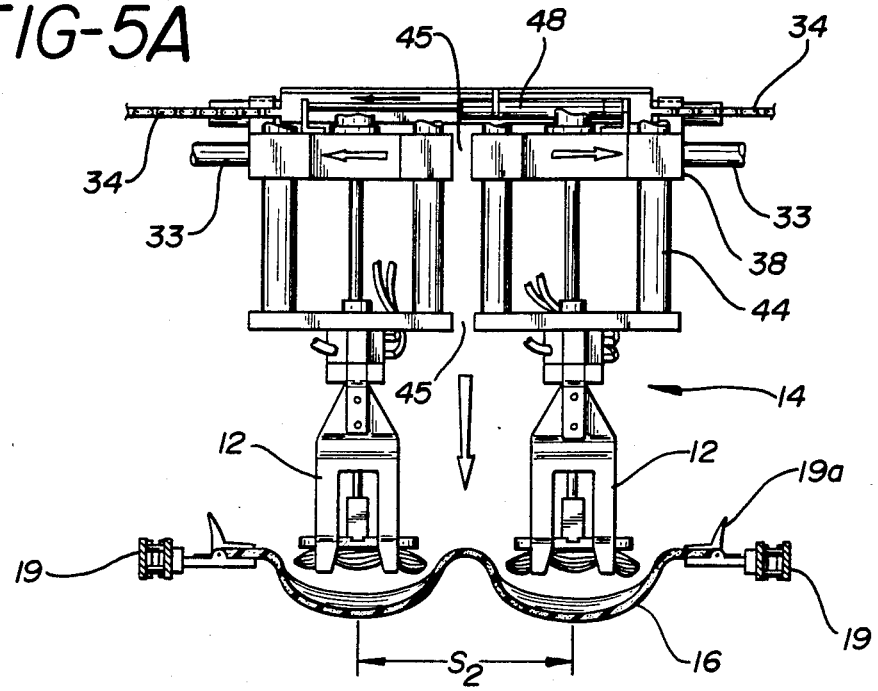
FIG. 5A shows a detail elevation view of the apparatus of FIG. 5 for placing the multiple parallel web pieces into the formed shells.

During the lateral transfer movement of the crimped web pieces 10*a* by the carrier unit 32, the end-to-end spacing of the web pieces can be changed if desired. To provide for this horizontal spacing change capability, the carrier device 32 is provided in two parts 32*a* and 32*b* which are split vertically at 45, as shown by FIGS. 5 and 5A. During the lateral transfer movement for multiple pieces 10*a* by carrier unit 32, the spacing "S" between carrier parts 32*a* and 32*b* is changed by horizontal piston means 48 attached to intermediate member 38, as needed to match the longitudinal spacings S1 of the web pieces 10*a* on conveyor 20 to the spacing S2 of the shells 16 of sheet 18, as is generally shown by FIG. 5 and is shown in greater detail by FIG. 5A. The continuous foam sheet 18 is supported along its edges by being attached to a conveyor chain 19 by spaced clips 19*a* which grip the edges of the sheet.

Figure 5B:
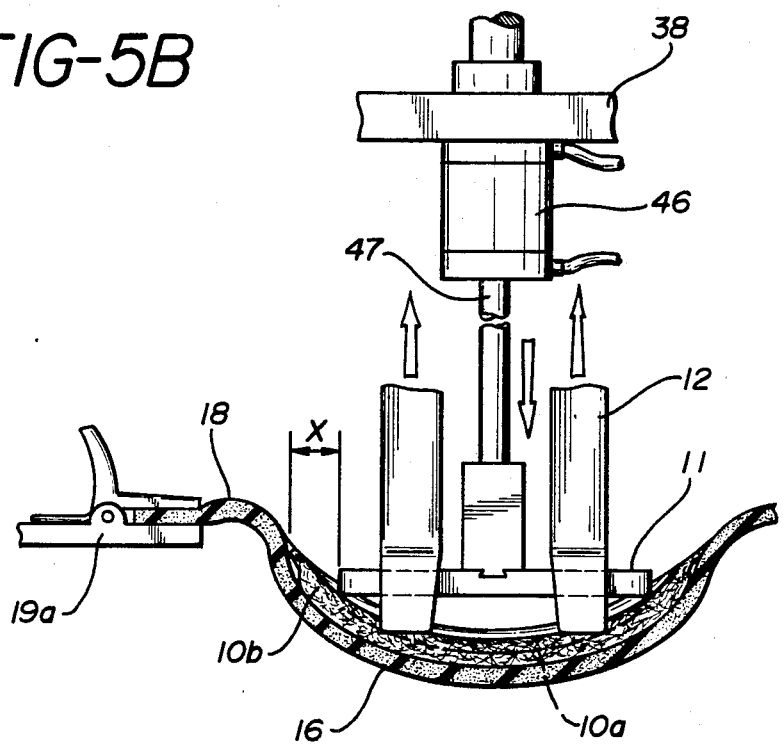
FIG. 5B shows a detail sectional view of a crimped web piece being inserted downwardly into a concave formed shell.

As shown in FIG. 5B, the individual crimped web pieces 10*a* are inserted downwardly into shells 16 of sheet 18 by action of dual fingers 12 and stop-tamp 11.

Figure 6:
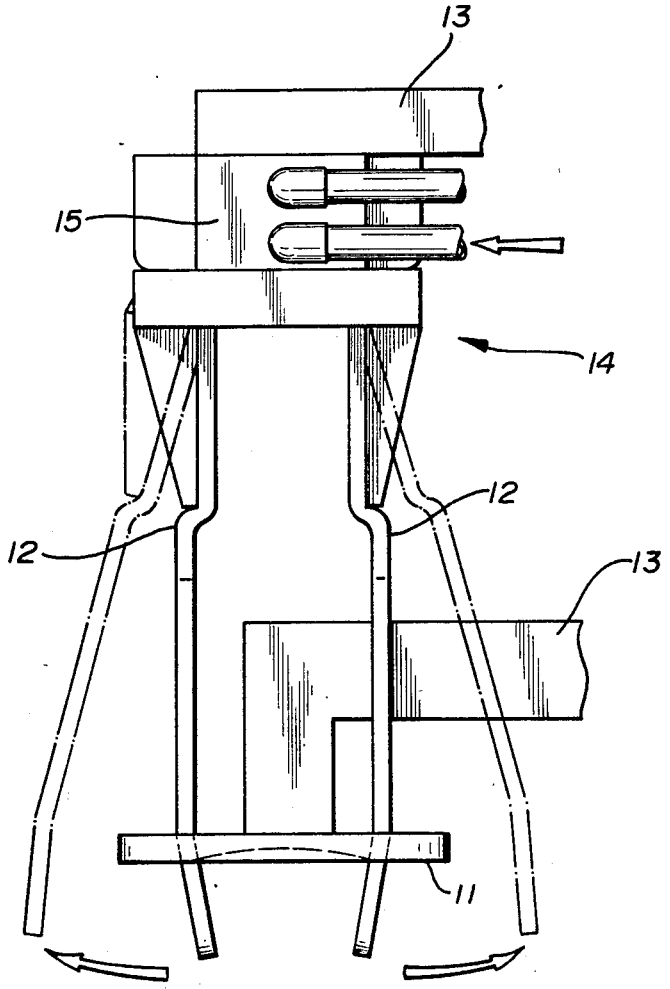
FIG. 6 shows an elevational view of the gripper unit taken along view lines 6—6 of FIG. 1 and showing how the dual fingers are swung outwardly after releasing a web piece.

For reliably inserting piece 10*a* into shell 16, the stop-tamp 11 is made shorted than web piece 10*a* at each end by a distance "X" equal to 0.1–0.2 times the length of the crimped web piece 10*a*. When the crimped web pieces 10*a* are placed into the shells 16, the gripper device 14 is moved downwardly by action of piston 46 and stop means 48 sufficiently far so that the web piece opposite ends 10*b* are bent upwardly by the end walls 16*b* of each shell 16, so as to provide a snug fit of piece 10*a* into each shell. After placing a web piece 10 into shell 16, the fingers 12 are sprung open by action of actuator piston 15 as shown by FIG. 6 to release the web piece.

The movement steps of the method for picking and placing flexible web pieces into formed shells are synchronized and occur sequentially. The cycle time for the total movement is usually less than about 6 seconds and is preferably 3–5 seconds, so that 10–20 pick and place cycles per minute are performed for the web pieces 10.

This invention will be further described by reference to the following example of operations, which should not be construed as limiting in scope.

EXAMPLE

Eight flat fibrous web pieces are provided from a die cutting operation onto support rails of a shuttle conveyor device. The web pieces are each longitudinally corrugated and composed of dual layers of polyester fibers, and each have dimensions of 6 inches long by 3 inches wide and 0.5 inches thick. The web pieces are oriented in a 2×4 pattern, i.e. with two rows of four pieces each in an end-to-end relation with each other as generally shown in FIG. 4. The web pieces are placed onto dual upwardly extending pins attached to blocks of a shuttle conveyor, and the web pieces are moved apart laterally from each other by 1.5 inches.

The eight web pieces are each grasped simultaneously and are longitudinally crimped by dual clamp fingers, and the pieces are picked up and transferred laterally to above a plurality of formed shells in a foam sheet arranged in a similar 2×4 pattern. During the lateral transfer movement, the end-to-end spacing of the web pieces is reduced by 1 inch, i.e., the web pieces are moved closer together. The respaced web pieces are then each inserted into a corresponding concave shaped formed shell of the foam sheet. The cycle time for the entire picking and placing maneuver is 4 seconds.

Although this invention has been described broadly and in terms of a preferred embodiment, it will be understood that modifications and variations can be made within the scope of the invention, which is defined by the following claims.

We claim:

1. A method for placing multiple flat flexible pieces into corresponding concave formed shells, comprising:

(a) providing at least two of flat flexible elongated pieces disposed in parallel relation to each other on support rails;

(b) picking up each said piece while simultaneously longitudinally crimping the piece to have a convex-shaped upper surface; and (c) transferring laterally each said crimped piece and placing it into a concave formed shell, which is shaped to retain the crimped pieces in the shell.

2. The method of claim 1, including moving the parallel pieces laterally apart from each other on the support rails before picking up the pieces.

3. The method of claim 1, wherein the flexible pieces are longitudinally crimped by dual pivotable fingers grasping sides of a central portion of each said piece.

4. The method of claim 1, including additionally bending upwardly opposite ends of each said piece while placing the piece into the formed shells.

5. The method of claim 2, wherein the parallel disposed pieces are moved laterally apart from each other by blocks of a shuttle conveyor, said blocks having upwardly extending pins inserted into the pieces.

6. The method of claim 5, wherein at least two pieces are provided in an end-to-end relationship to each other, and the pieces are placed on upwardly extending pins of the shuttle conveyor and the pieces are moved apart laterally by the shuttle conveyor.

7. The method of claim 1, wherein the adjacent pieces are moved longitudinally relative to each other while simultaneously being transferred laterally from the shuttle rails to the formed shells.

8. The method of claim 1, wherein the pieces are picked up and transferred into the formed shells during a cycle time of 2–5 seconds.

9. The method of claim 1, wherein the elongated flexible pieces are a fibrous web material, each piece having dimensions of 6–10 inches long, 3–5 inches wide and 0.4–1 inch thick.

10. A method for placing multiple elongated pieces of flat fibrous web each into corresponding concave formed shells, said method comprising:

(a) providing a plurality of corrugated flat flexible web pieces disposed in parallel relation to each other on rails of a shuttle conveyor;

(b) moving the parallel web pieces laterally apart from each other while dispposed on the shuttle conveyor;

(c) picking up each said web piece while simultaneously longitudinally crimping the piece to have a convex-shaped upper surface;

(d) transferring laterally each said crimped web piece and moving the adjacent parallel web pieces longitudinally while simultaneously transferring the web pieces to the formed shells; and (e) placing each said crimped web piece into a concave formed shell which is shaped to retain the crimped web piece in the fomed shell, including additionally bending upwardly the opposite ends of each said web piece while inserting the piece into the concave shell.

11. An apparatus for placing multiple flat flexible pieces into formed shells, comprising:

(a) conveyor means adapted for retaining multiple flexible pieces, said conveyor means including parallel rails for supporting the pieces and having a shuttle located below the rails for contacting and longitudinally moving the pieces;

(b) gripper means adapted for clamping and picking up the multiple pieces and crimping each piece longitudinally; and (c) transfer means for moving the multiple crimped pieces transversely, and placing each piece into a specific location in a formed shell.

12. Apparatus according to claim 11, wherein said shuttle includes upwardly extending pins adapted for retaining and moving apart the adjacent pieces.

13. Apparatus according to claim 11, wherein said gripper means includes dual pivotable fingers having a stationary stop plate located therebetween, whereby said dual fingers pivot inwardly to grip the central portion of a flexible piece and pivot outwardly to release the piece.

14. Apparatus according to claim 11, wherein said transfer means includes a carriage unit supported on dual rods and moved transversely by an endless chain running over dual sprocket wheels.

15. Apparatus according to claim 11, wherein said transfer means consists of two adjacent parts each adapted for being moved apart relative to each other while moving the web pieces in an end-to-end relationship to each other during their transverse movement.

16. An apparatus for placing multiple flat flexible pieces into concave formed shells, comprising:

(a) conveyor means adapted for retaining multiple flat flexible pieces, said conveyor means for supporting the pieces and including parallel rails having a shuttle located below the rails for contacting and simultaneously moving apart the adjacent pieces;

(b) gripper means adapted for clamping and picking up the adjacent multiple pieces and crimping each piece longitudinally;

(c) transfer means including a carriage unit supported on dual rods and moved transversely by an endless chain running over dual sprocket wheels and adapted for moving the multiple crimped web pieces transversely, and placing each piece into a specific location in a concave formed shell.

* * * * *